US008050442B1

(12) United States Patent
Graber

(10) Patent No.: US 8,050,442 B1
(45) Date of Patent: Nov. 1, 2011

(54) CASCADED TRANSDUCER ARRAY ARRANGEMENT FOR CONTROL OVER AN ACOUSTIC PRESSURE GRADIENT THROUGH A HORN

(76) Inventor: Curtis E. Graber, Woodburn, IN (US)

( * ) Notice: Subject to any disclaimer, the term of this patent is extended or adjusted under 35 U.S.C. 154(b) by 500 days.

(21) Appl. No.: 12/322,306

(22) Filed: Jan. 29, 2009

(51) Int. Cl.
*H04R 1/20* (2006.01)

(52) U.S. Cl. ..... 381/342; 381/340; 381/341; 181/144; 181/152; 181/194

(58) Field of Classification Search ..... 381/186, 381/340–342; 181/145, 152, 159, 177, 192, 181/194, 195
See application file for complete search history.

(56) References Cited

U.S. PATENT DOCUMENTS

| | | | | |
|---|---|---|---|---|
| 4,845,759 | A * | 7/1989 | Danley | 381/97 |
| 5,526,456 | A | 6/1996 | Heinz | |
| 6,411,718 | B1 | 6/2002 | Danley et al. | |
| 7,454,030 | B2 | 11/2008 | Graber | |
| 2005/0047622 | A1 * | 3/2005 | Graber | 381/342 |

* cited by examiner

*Primary Examiner* — Ramon Barrera
(74) *Attorney, Agent, or Firm* — O'Malley and Firestone

(57) ABSTRACT

A horn based loudspeaker system provides control over peak to peak pressure of an acoustic signal across its frequency spectrum. Frequency spectrum matched acoustic energy added to the acoustic signal at diverse points distributed along the horn.

10 Claims, 10 Drawing Sheets

CASCADED TRANSDUCER ARRAY ARRANGEMENT FOR CONTROL OVER AN ACOUSTIC PRESSURE GRADIENT THROUGH A HORN

BACKGROUND OF THE INVENTION

1. Technical Field

The invention relates to an electro-acoustical device and, more particularly, to a horn loudspeaker particularly suited for reproducing low frequency audible sound at high output levels.

2. Description of the Problem

The reproduction of sound in a compressible medium, such as air, particularly at high intensity levels, poses a number of challenges. One problem is the low efficiency exhibited by compression drivers in transferring energy to air. Conceptually this lack of efficiency is modeled as an impedance problem. Air exhibits an impedance which is low and highly non-resistive in character. The problem of the impedance mismatch has been addressed by use of structures to increase the resistive component of the impedance seen by a compression driver transducer for a given volume of air. A baffle supporting a line array of compression drivers is one such structure. An alternative structure is the horn. A horn is, in effect, an acoustic transformer, and provides an output performance equivalence to a driving unit having a large area diaphragm using a transducer with a relatively small area diaphragm while minimizing cone/diaphragm resonance issues that exist with direct radiator devices. The horn renders radiation impedance seen at the diaphragm increasingly resistive for a given volume velocity of air with the result that increasing power is radiated at a given input power. A horn achieves these results by restricting movement of the air, in other words, movement of the compression driver produces greater local pressure changes than would otherwise occur.

Increasing the acoustic power output from most horn designs has required increasing diaphragm piston travel in order to achieve the required volume velocity of air. Piston travel has been an important limiting factor relating to the amount of power that could be delivered to the horn. This had been seen as limiting the energy that could be introduced to a horn in a given frequency range.

In U.S. patent application Ser. No. 10/649,040, filed 27 Aug. 2003, now issued as U.S. Pat. No. 7,454,030, which is expressly incorporated herein by reference, the present inventor proposed a horn incorporating a plurality of transducers operating in the same frequency range. The transducers were ported to the horn with the ports being distributed along a portion of the propagation axis of the horn. The same drive signal, differentiated only by a phase delay, is supplied each transducer. This allowed the sound wave propagating along the horn to be reinforced in a cascade. By folding the horn, a high volume, low frequency, sound-source was built into a relatively small, energy efficient, package. This package was portable enough to be moved and suitable for open air use resulted from this arrangement. The problem of limited piston travel was addressed in part by dividing the work among a plurality of transducers and adding energy progressively, that is, in a cascade fashion lengthwise along a section of the horn. However, the patent gave no particular guidance relating to spacing between ports from transducer pre-load chambers into the horn or to calibrating the intensity of the output from each transducer. It was sufficient that operation of the transducers produce an output which matched the phase of the wave as it propagated past each port and, implicitly, operated at their power limits without incurring excessive distortion effects in order to maximize the power transferred to the acoustic output.

U.S. patent application Ser. No. 11/362,933, filed 27 Feb. 2006, and now issued as U.S. Pat. No. 7,760,899, is also expressly incorporated herein by reference. In the '933 application the present inventor proposed a modification to the development of the '040 application in which the spacing between output ports was progressively increased along a horn. This arrangement improved Q (directivity).

Other horn designs are known which position transducers at locations spaced from the throat or apex of the horn including horns in which transducers are differentially spaced from a horn "apex" toward the mouth. Such horns have been referred to variously as "multiple entry" horns, "coentrant" horns and "unity summation aperture" horns. These horns position compression drivers at stepped distances from a horn apex. However, all of the compression drivers for a particular frequency range are grouped at a particular spacing from the apex with the highest frequency device(s) being located at the apex and devices suited for lower bandwidths located progressively closer to the horn mouth. U.S. Pat. No. 6,411,718 to Danley et al. exemplifies such devices, showing application to a conical, or more particularly, a pyramid shaped horn.

SUMMARY

A loudspeaker system incorporating a horn provides control over peak to peak pressure of an acoustic wave of a particular frequency spectrum as it propagates through the horn so that it varies from would be obtained from the characteristic flare of the horn. Typically, peak to peak pressure of the acoustic signal is maintained at, or more typically periodically restored, to an initial value.

In order to adjust peak to peak pressure of an acoustic signal while maintaining its initial frequency spectrum as it propagates through a horn there are provided ports with outlets into the horn staged along a portion the horn which is effective for enhancing the effective impedance seen at the frequency spectrum of the signal. Acoustic energy matching the frequency spectrum of the acoustic signal may be added to the acoustic signal (alternatively, acoustic energy may be cancelled from the acoustic signal inserting energy 180 degrees out of phase) at each successive port. A constant pressure solution is just one possibility.

The particular arrangement of the outlets from ports at successive stages along the horn depends on the flare of the horn. Typically the system transducers are compression drivers coupled to the horn by pre-load chambers and ports. The system is simplified by making all of the transducers intended for use over a particular frequency range identical to one another. For horns having an initially rapidly increasing cross sectional area, such as conic horns, and because transducer travel issues remain present, an increasing number of transducers will be provided at each stage. For a horn having an initially slowly increasing cross sectional area the early stage transducers can be operated below their travel limit for the early stages and the number of transducers, and ports into the horn, need not increase with each stage.

Where the relative ratio of the power to be applied to the compression drivers fixes the area of the ports on the interior surface of the horn can be fixed in ratio to the cross sectional area of the horn locally, or to the power ratio.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION

An acoustic horn is a tube whose cross-sectional area expands from one end to the other. In a conventional horn applied to sound propagation, the narrower end of the horn is termed the throat and provides the location for mounting of the transducer to radiate into the horn. The opposite, larger cross-sectional area end of the horn is termed the mouth. In the present application transducers are distributed along a discrete portion of the length of the horn termed the "summing throat" with the narrow end of the horn being termed as the horn's "apex".

Horns are categorized by their longitudinal section type. The most common categories of horn described in the art are exponential, parabolic, conical and hyperbolic. The conical type exhibits a constant flare, the hyperbolic and exponential have increasing flares and the parabolic a decreasing flare with increasing distance from the throat or apex. A number of criteria affect the choice of horn type for a given application. For example, in lower frequency or bass ranges, a hyperbolic horn gives superior loading conditions. However, non-linear distortion is increased in such horns due to the physical length of such horns, which is dictated by their relatively slow initial increase in cross-sectional area. A conical horn minimizes non-linear distortion due the shorter overall lengths possible in such horns but is less effective as an impedance enhancing device. Hyperbolic horns have often been viewed as a good compromise between conical and exponential flares for such applications.

Because the flare constant and longitudinal section (or flare type) of a horn determines the rate of increase in cross sectional area of the horn, the rate of increase in cross sectional area determines the rate of decrease in peak to peak pressure of a sound wave propagating through the horn. In other words, the pressure gradient is inverse to flare constant and determined by the flare type, disregarding parasitic losses such as friction. Horn diameter relative to wavelength of the sound determines the effectiveness of the horn as an impedance matching device, with transformer gains declining as the wavelength of the radiated sound approaches the diameter of the horn locally.

Figure 1:
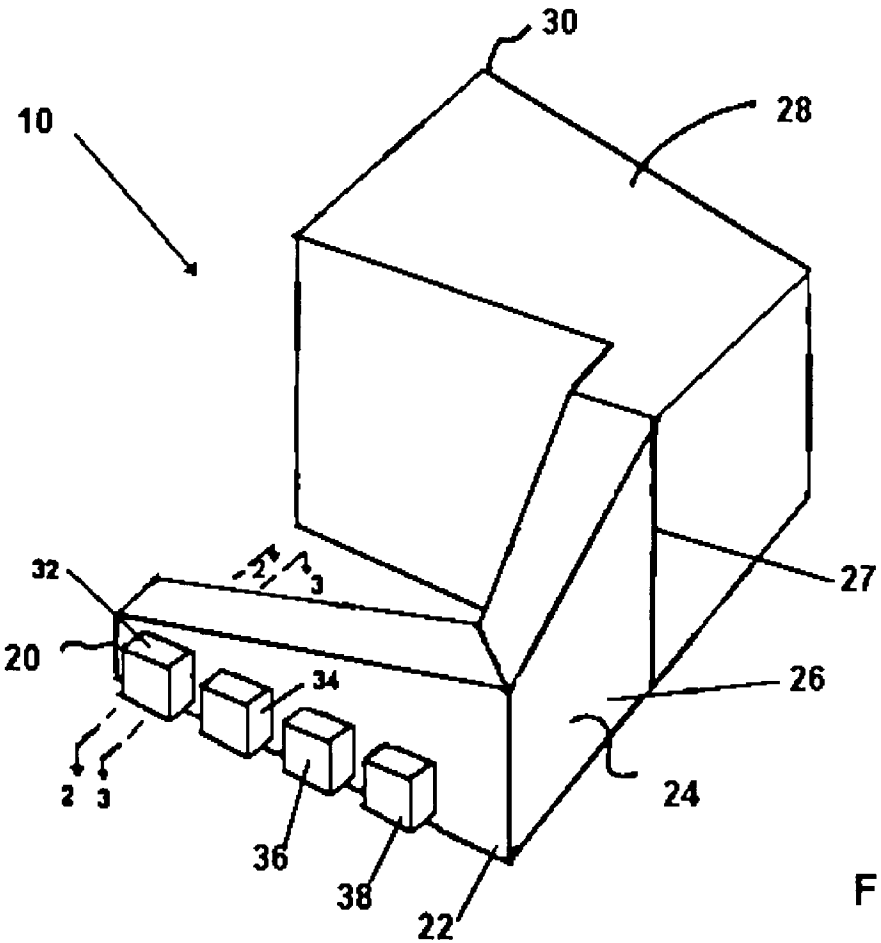
FIG. 1 is a perspective view of a folded horn incorporating the transducer and port arrangement of the present invention.

Referring now to the figures, several embodiments applied to conic horns of differing flare constants are illustrated. FIG. 1 illustrates a loudspeaker system 10 according to one such embodiment. Loudspeaker system 10 incorporates a folded horn 12 having an apex 20 and mouth 30. Between the apex 20 and the mouth 30 the horn may be conceptualized as including two sub-sections 24 and 28 divided by an indeterminately located boundary 26. Sub-section 24 may be termed the transformer section, that is the region of the horn which is effective at transforming the impedance seen by the transducers of driver sub-assemblies 32, 34, 36 and 38. Sub-section 24 extends from the apex 20 to the movable boundary 26 located between the last driver sub-assembly 38 and a waveguide extension section 28. Transformer section 24 is characterized over its entire length by a longitudinal section type, here a conic, which terminates at crease 27.

Waveguide extension section 28 is generally increasing in area over its length, but need not track the characteristic section type of the transformer section 24. The location of the border 26 to the transformer section 24 will be indeterminate because its location depends frequency spectrum of the acoustic signal in the horn. It may be desirable that the frequency spectrum of the sound generated by loudspeaker 10 be chosen so that the boundary 26 does not move past crease 27. Driver sub-assemblies 32, 34, 36 and 38 are disposed along a leg 22 of the folded horn which lies well within in likely range of the transformer section 24. For highest efficiency it is desirable that ports from the driver sub-assemblies into the horn 12 feed into the transformer section 24. It is possible that some ports may be located past boundary 27 over some operating frequencies, whereupon it might be desirable, from an efficiency point of view, to disable the transducers associated with those ports. As long as the location of boundary 27 can be determined for a given frequency set (in other words the shortest significant wavelength of the sound propagating through the horn and the diameter of the horn at each port are known) this should be readily predictable. The driver sub-assemblies 32, 34, 36 and 38 are generally located close to the ports into the horn 12 to mitigate friction losses among other things, but this is not necessarily required.

Figure 2:
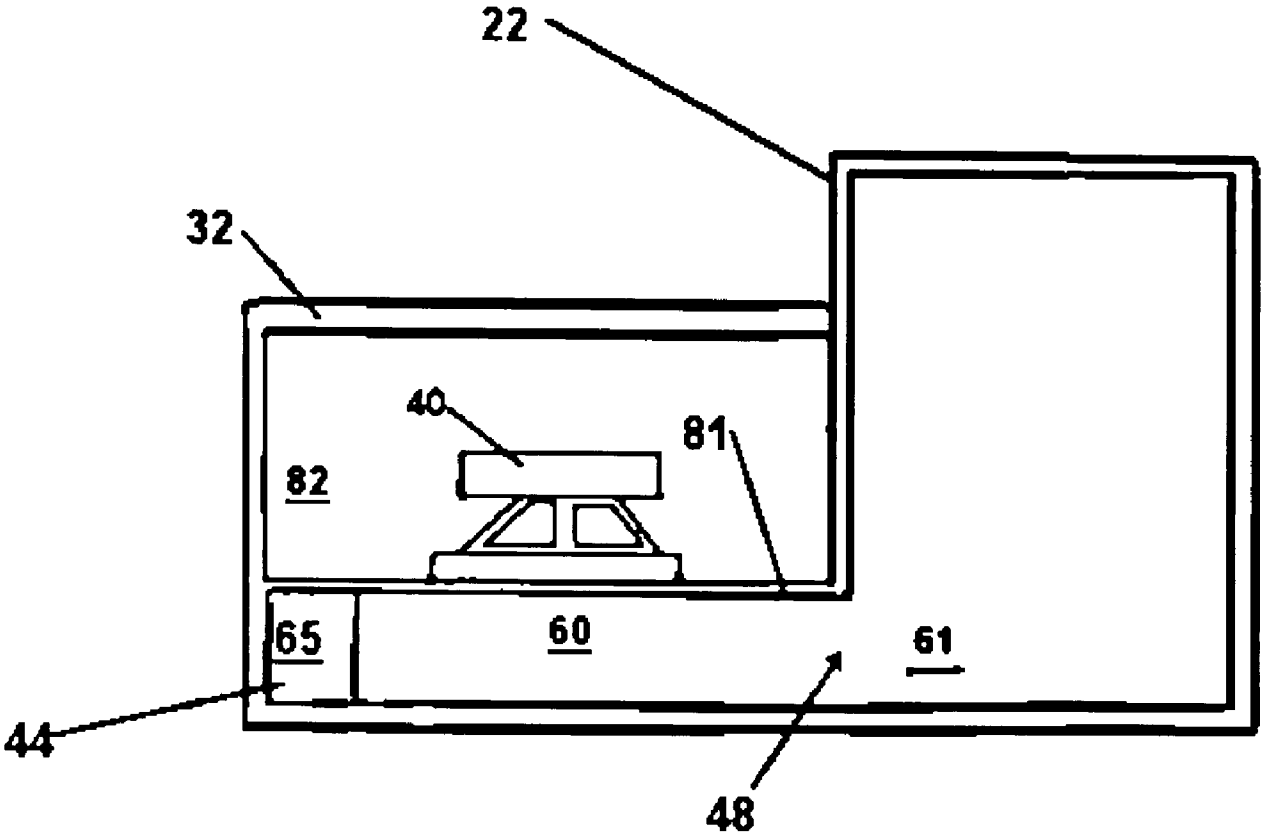
FIG. 2 is a cross sectional view of a driver sub-assembly from FIG. 1 taken along section lines 2-2.
Figure 3:
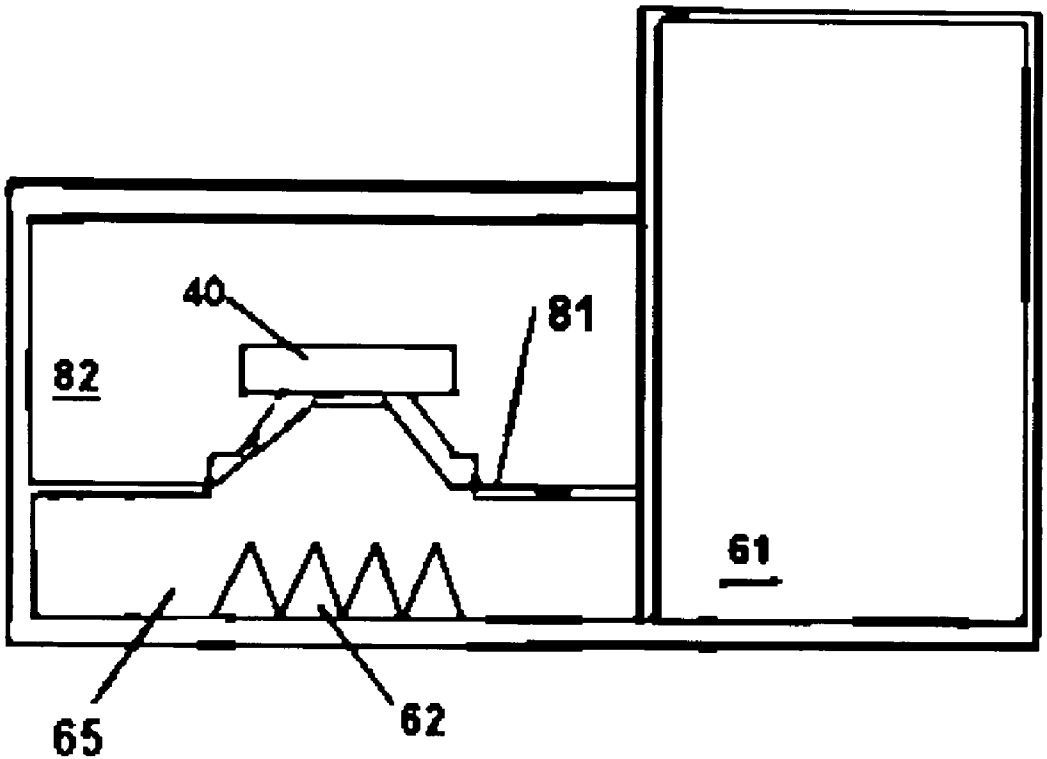
FIG. 3 is a cross sectional view of a driver sub-assembly from FIG. 1 taken along section lines 3-3.

FIGS. 2 and 3 are cross sectional views of a representative driver sub-assembly 32. FIG. 2 is taken along a port 60 connecting a pre-load chamber 65 to an internal segment 61 of transformer section 24. FIG. 3 is taken through the pre-load chamber 65 which is directly exposed to driver 40. Port 60 connects pre-load chamber 65 through an aperture 44 to a tap 48 on an interior face of a wall defining one interior side of transformer section 61 of horn 12. Driver/transducer 40 is mounted in a baffle 81 separating a high pressure back chamber 82 from the preload chamber 65. One face of the pre-load chamber 65 is partially covered with an absorbent pad 62 facing the transducer 40 to dampen resonance.

Figure 4:
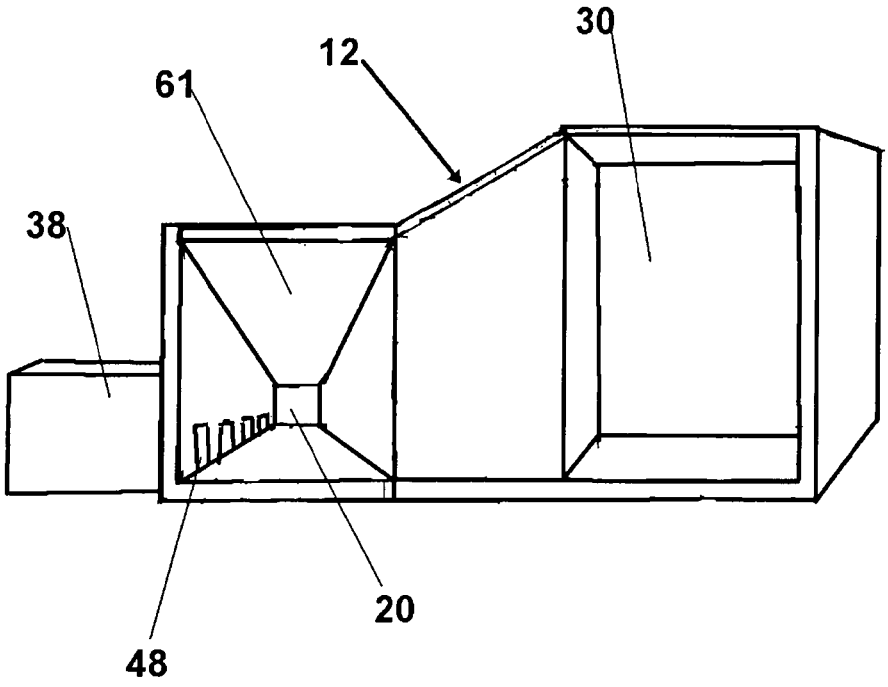
FIG. 4 is a cut away view of the folded horn of FIG. 1.

FIG. 4 illustrates an end on, cut-away view of horn 12 showing a progression of taps 48 from driver sub-assemblies, including sub-assembly 38, into interior transformer section 61. The interior apex 20 of horn 12 lies at the deepest recess of the interior transformer section 61. Mouth 30 is also shown. Here the taps 48 are at equally spaced stages progressing outwardly along the horn 11 from the apex 20.

Figure 5:
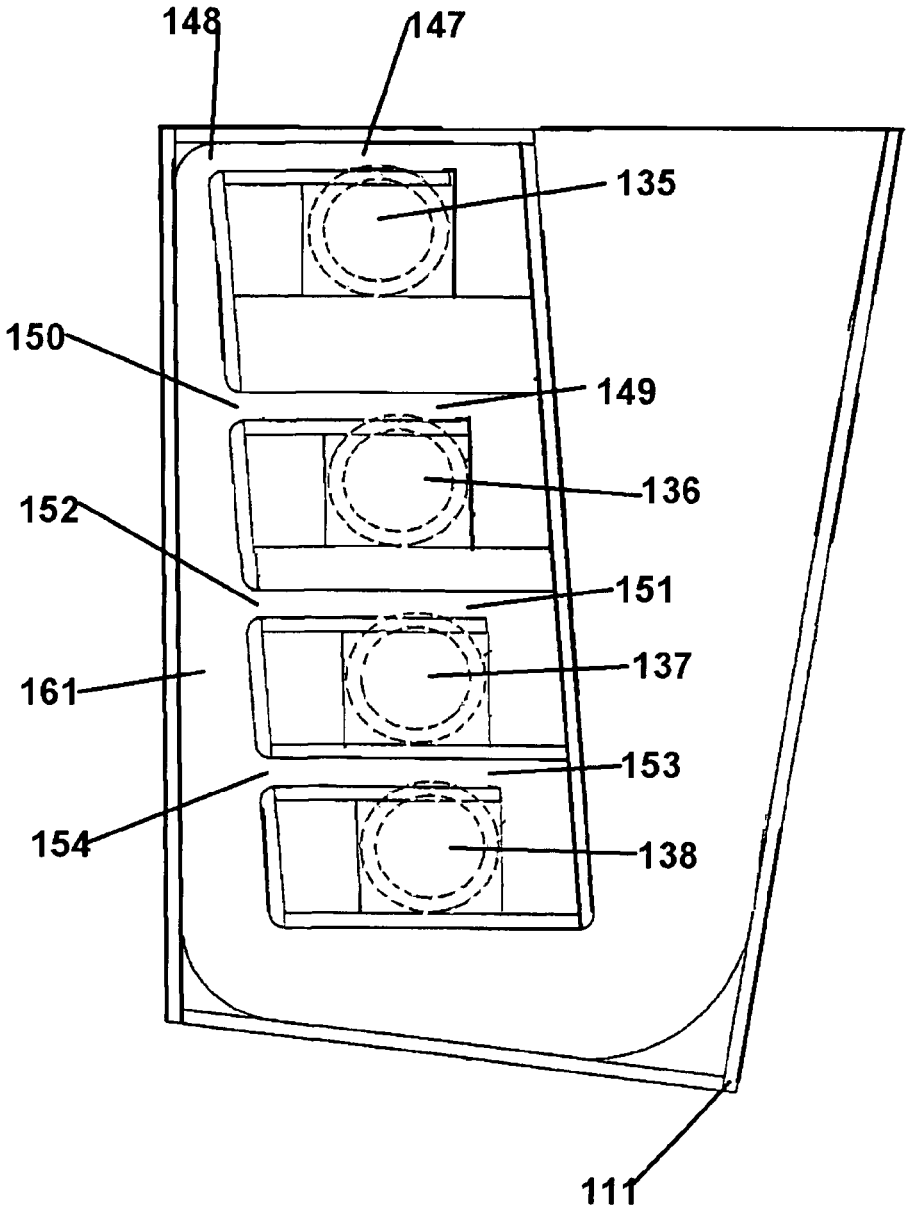
FIG. 5 is a cross section of a folded horn incorporating an alternative driver sub-assembly arrangement.

FIG. 5 illustrates a reconfigured horn 111 which changes the spacing between taps 148, 150, 152 and 154 in order to simplify the operation of the system for restoring peak to peak pressure at each successive stage. Horn 111 incorporates four transducer/drivers 135, 136, 137 and 138, which are acoustically coupled by ports 147, 149, 151 and 153 to the transformer section 161 of horn 111. Transformer section 161 is conical, which means the cross sectional area of the horn increases with the product of the waveguide height and width (or for a conical horn of circular cross-section, by the square of the radius). Assuming that it is desired that the peak to peak pressure at each successive stage be returned to the initial peak to peak pressure, and that the same quantum of energy is inserted at each stage, than successive stages moving downstream must be ever more closely spaced. The opposite result is obtained for a parabolic section horn.

Figure 6:
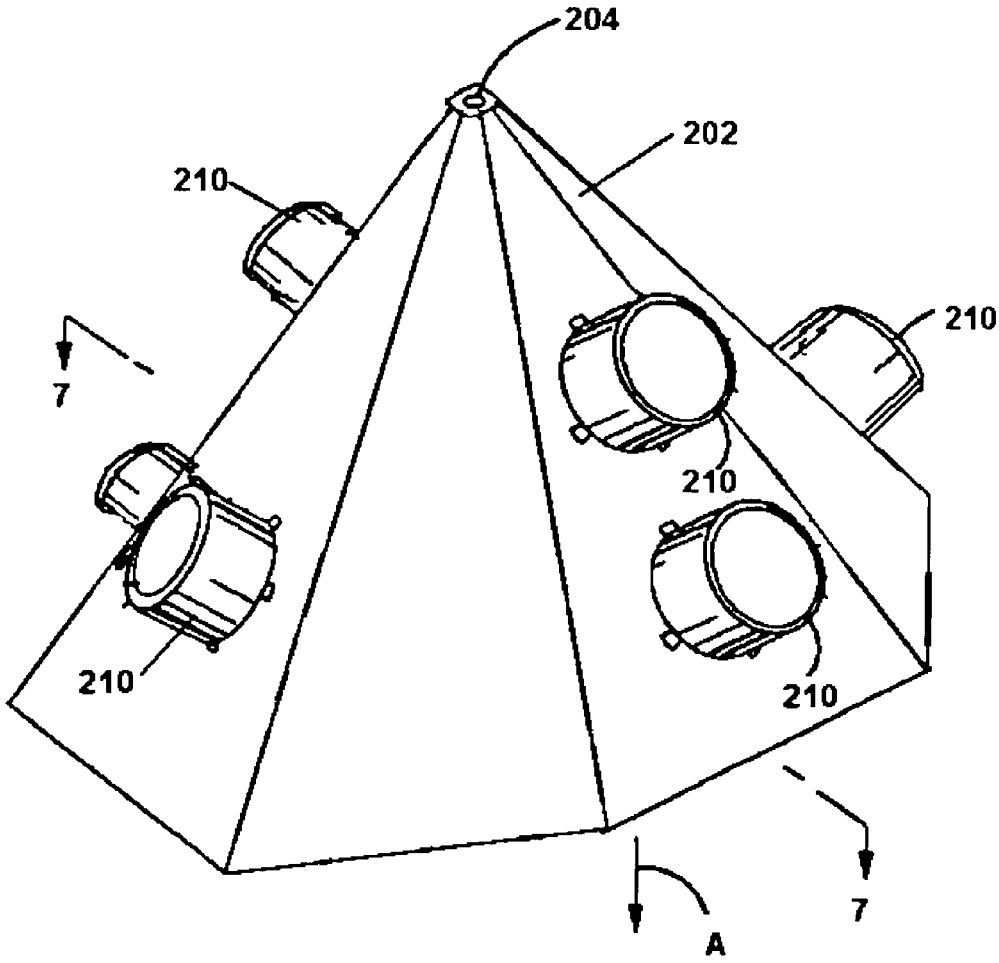
FIG. 6 is a perspective view of a loudspeaker system according to an alternative embodiment of the invention.

FIG. 6 is an alternative embodiment of a loudspeaker 200 characterized by a higher flare constant and incorporating an increased number of transducer at a second stage of energy insertion (here illustrated with two drivers (driver sub-assemblies 210) for a first stage and four driver sub-assemblies at the second stage. Here it is assumed that the distance spacing the first and second stages was chosen so that the cross-sectional area of the horn at the second stage was twice the cross-sectional area at the first stage. The apex 204 of the horn 202 is aligned on the sound axis A.

Figure 7:
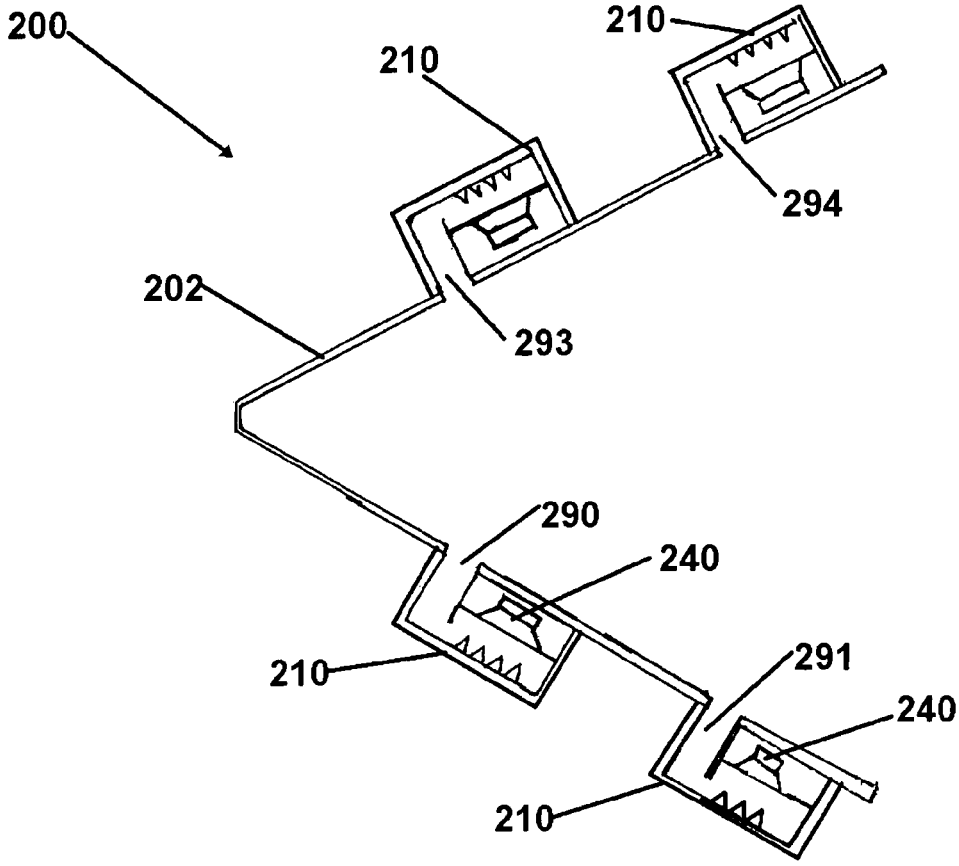
FIG. 7 is a cross-sectional view of the loudspeaker system of FIG. 6, taken along section lines 6-6.
Figure 8:
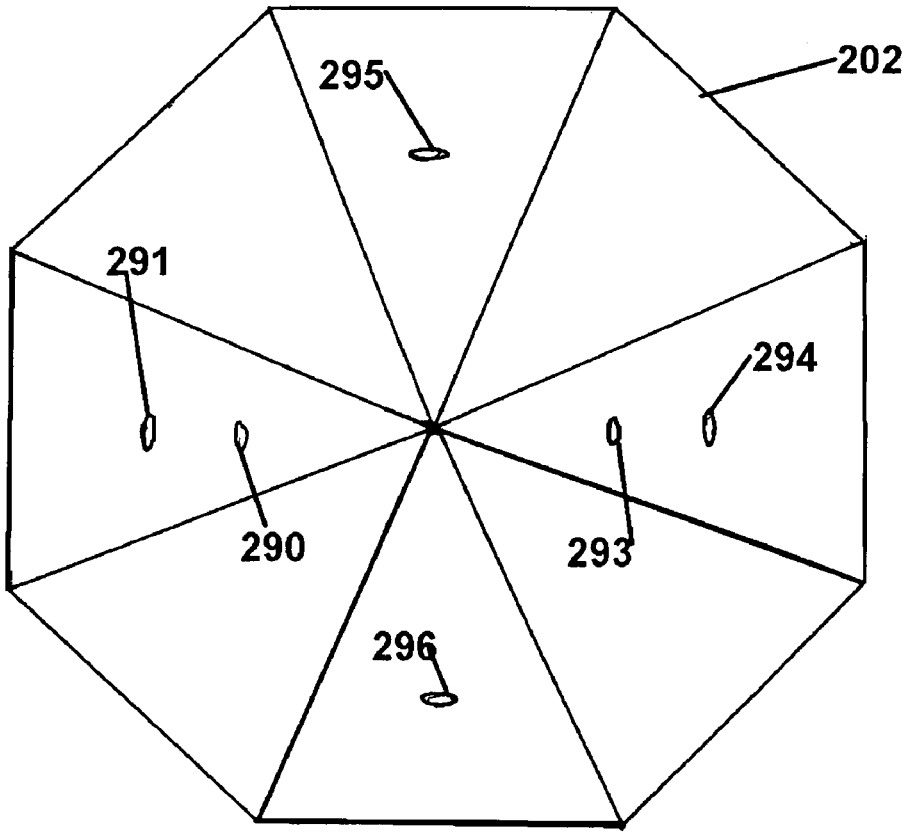
FIG. 8 is an end view looking into the mouth of the horn of the loudspeaker of FIG. 6.

FIG. 7 is a cross section of loudspeaker system 200 taken along section line 7-7 of FIG. 6. Driver sub-assemblies 210 each house a transducer/driver 240 which is ported (290, 291, 293, 294) into horn 202. The distribution of ports 290, 291, 293, 294, 295 and 296 is best viewed into the mouth of horn 202 as shown in FIG. 8.

Figure 9:
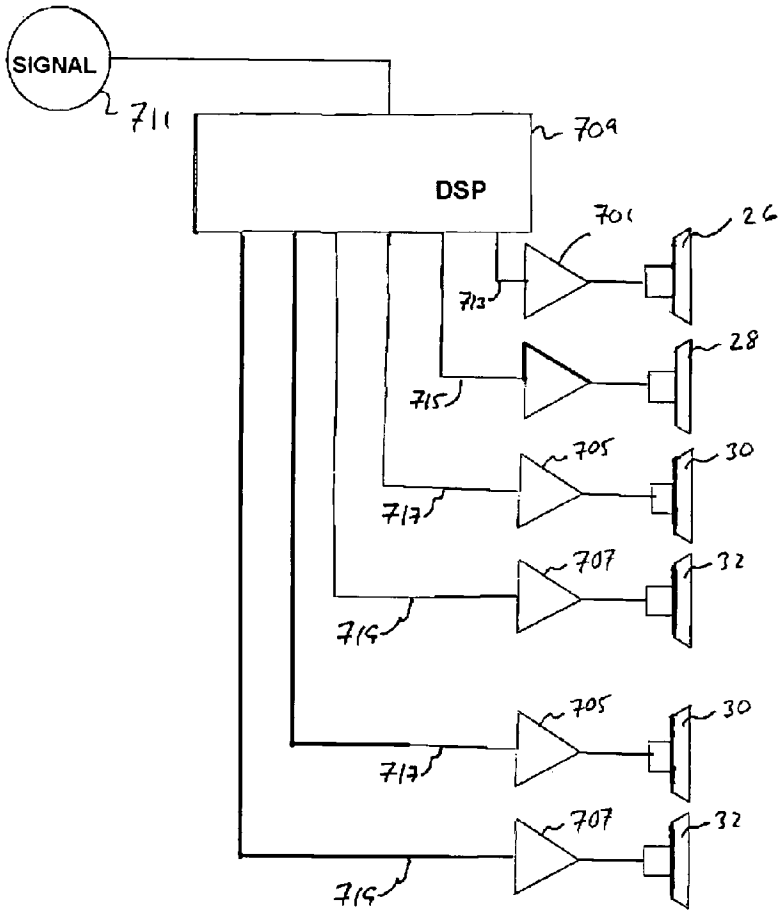
FIG. 9 is a block diagram of a control circuit for a loudspeaker system built in accordance with the teachings of the invention.
Figure 10:
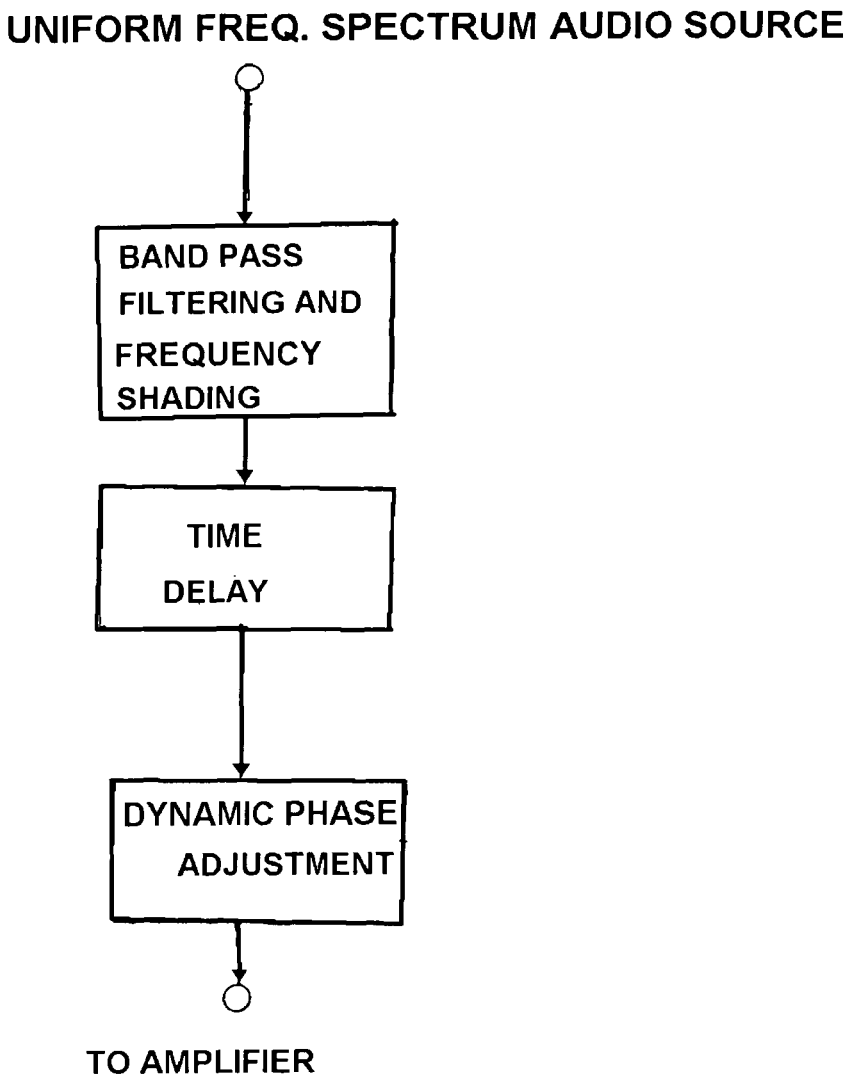
FIG. 10 is a flow chart illustrating control over drive signals used to excite a loudspeaker.

FIG. 9 is a block diagram for applying audio frequency drive signals to the transducer/drivers 240 of FIG. 7. Essentially the same signal, provided by a source 501, is supplied to a digital signal processor 503, where the signal is subject to phase adjustment, time delay and possibly some band and frequency shading before the signal is applied to each of transducers 240. It is possible for frequency shading to be done to accommodate slightly different frequency responses of the horn at different stages of the horn (See. FIG. 10). Amplifiers 505, 507, 509, 511, 513, 515 may be adjusted to equalize the signals, or to differentiate the level of amplification to meet other desired design objectives.

What is claimed is:

1. A loudspeaker system comprising:

a horn having a mouth and an apex;

at least first and second transducers acoustically coupled into the horn at first and second locations differentially spaced from the apex;

a transducer drive signal source for said first and second transducers, the transducer drive signal source supplying drive signals to the first and second transducers having substantially matched frequency spectrums; and signal processing circuitry for controlling the amplitude and phase angle of the transducer drive signal applied to the second transducer to meet a peak to peak pressure target having a fixed relation to an initial peak to peak pressure for an acoustic signal generated by the first transducer.

2. The loudspeaker system of claim 1, further comprising:

the horn having a transformer section adjacent the apex and a waveguide section adjacent the mouth.

3. The loudspeaker system of claim 2, further comprising:

the plurality of transducers being compression drivers.

4. The loudspeaker system of claim 3, further comprising:

the plurality of transducers being apportioned to ports having outlets to the horn progressing from the apex toward the mouth in steps, with the surface area of the outlets from the ports increasing from the apex in the direction of the mouth.

5. The loudspeaker system of claim 4, further comprising:

the number of transducers increasing in number with each step of progression from the apex.

6. The loudspeaker system of claim 5, the ports being coupled into the transformer section and the signal processing circuitry adjusting power applied to transducers acoustically coupled to successive ports having outlets progressing away from the apex to maintain peak to peak pressure of an acoustic signal propagating through the transformer section.

7. A loudspeaker system comprising:

a horn having an apex and a mouth;

a source of a drive signal having defined frequency spectrum within an allowed spectrum set;

for any defined frequency spectrum set, a known length of the horn extending from the apex corresponding to a transformer section;

a plurality of transducers for producing acoustic signals in response to application of the drive signal;

a plurality of ports acoustically coupling the plurality of transducers into the horn, the plurality of ports being distributed among stages located differentially spaced from the apex along the transformer section for the defined frequency spectrum set; and amplifier stages for coupling the drive signal to the transducers with the relative power of the drive signal as applied to each transducer being selected to fix a selected peak to peak pressure profile for the acoustic signal as a function of distance from the apex of the horn.

8. The loudspeaker system of claim 7, further comprising:

the amplifier stages applying a substantially unitary power ratio to the transducers with the ports and numbers of transducers selected for each stage so that the peak to peak pressure ratio is maintained as an acoustic wave propagates through the transformer section.

9. The loudspeaker system of claim 7, further comprising:

each successive stage of increasing distance from the apex having an increased number of ports over the prior stage and each transducer radiating into a preload chamber connected to the horn by the port for the transducer.

10. The loudspeaker system of claim 9, further comprising:

the horn having a conic longitudinal section.

* * * * *